US009222276B2

(12) United States Patent
Stenswick

(10) Patent No.: US 9,222,276 B2
(45) Date of Patent: Dec. 29, 2015

(54) SEISMIC ISOLATION SYSTEM

(71) Applicant: Larry Ellsworth Stenswick, Methven (NZ)

(72) Inventor: Larry Ellsworth Stenswick, Methven (NZ)

( * ) Notice: Subject to any disclaimer, the term of this patent is extended or adjusted under 35 U.S.C. 154(b) by 0 days.

(21) Appl. No.: 14/701,316

(22) Filed: Apr. 30, 2015

(65) Prior Publication Data

US 2015/0315805 A1 Nov. 5, 2015

(51) Int. Cl.

| | |
|---|---|
| ***E04B 1/98*** | (2006.01) |
| ***E04H 9/02*** | (2006.01) |
| ***E04B 1/36*** | (2006.01) |
| ***E04B 1/41*** | (2006.01) |
| ***E02D 27/34*** | (2006.01) |
| ***E02D 27/12*** | (2006.01) |

(52) U.S. Cl.

CPC ..... *E04H 9/021* (2013.01); *E02D 27/12* (2013.01); *E02D 27/34* (2013.01); *E04B 1/36* (2013.01); *E04B 1/40* (2013.01)

(58) Field of Classification Search

CPC ..... E04H 9/021; E04H 9/02; E02D 27/12; E02D 27/34; E02D 5/52; E02D 5/523; E04B 1/36

USPC ..... 52/169.9, 299

See application file for complete search history.

(56) References Cited

U.S. PATENT DOCUMENTS

| | | | | | |
|---|---|---|---|---|---|
| 3,350,821 | A | * | 11/1967 | Jones | 52/126.1 |
| 4,001,990 | A | * | 1/1977 | Chase et al. | 52/167.4 |
| 4,290,716 | A | * | 9/1981 | Lamy | 405/203 |
| 4,507,069 | A | * | 3/1985 | Murray et al. | 405/230 |
| 4,591,466 | A | * | 5/1986 | Murray et al. | 405/230 |
| 4,938,633 | A | | 7/1990 | Wu et al. | |
| 4,974,378 | A | | 12/1990 | Shustov | |
| 5,505,033 | A | * | 4/1996 | Matsuo et al. | 52/296 |

(Continued)

FOREIGN PATENT DOCUMENTS

| | | |
|---|---|---|
| CA | 2364694 | 6/2003 |
| EP | 0747538 | 12/1996 |

(Continued)

OTHER PUBLICATIONS

Thurston, SJ (2006); Base Isolation of Low Rise Light and Medium-weight Buildings, *BRANZ Study Report No. 156* (www.branz.co.nz) (2006).

(Continued)

*Primary Examiner* — Brian Glessner
*Assistant Examiner* — Gisele Ford
(74) *Attorney, Agent, or Firm* — ARC IP Law, PC; Joseph J. Mayo

(57) ABSTRACT

A seismic isolation building system, and method thereof, for buildings and other structures that is well suited to protect lightweight low rise buildings including houses against earthquakes, particularly where the structure is located in low lying wet regions subject to liquefaction. The system utilizes a platform with piles extending from the platform into a ground, wherein the piles are connected to the platform via at least one shear bolt that links a platform plate to a pile. The shear bolt or bolts are designed to shear in an event of a predetermined level of seismic activity freeing the platform and structure on the platform to move independent of the piles. Post seismic activity, the platform and structure are moved, repositioned and/or re-fixed to new or existing piles thereby minimizing damage to the structure and hence repair costs.

14 Claims, 4 Drawing Sheets

(56) References Cited

U.S. PATENT DOCUMENTS

| | | | | |
|---|---|---|---|---|
| 5,564,237 | A | 10/1996 | Yoneda | |
| 5,771,642 | A | 6/1998 | Lester | |
| 5,775,038 | A | 7/1998 | Sauvageot | |
| 5,964,066 | A | 10/1999 | Mori | |
| 5,980,162 | A | 11/1999 | McCown | |
| 6,092,341 | A | 7/2000 | Yamashita et al. | |
| 6,192,649 | B1 | 2/2001 | Karim-Panahi et al. | |
| 6,308,135 | B1 | 10/2001 | Hocking | |
| 6,659,691 | B1 | 12/2003 | Berry | |
| 6,725,612 | B2 | 4/2004 | Kim | |
| 6,745,852 | B2 * | 6/2004 | Kadaster et al. | 175/5 |
| 6,792,720 | B2 | 9/2004 | Hocking | |
| 6,862,848 | B1 | 3/2005 | Lang et al. | |
| 6,862,849 | B2 | 3/2005 | Kim | |
| 6,948,284 | B2 | 9/2005 | Chiang | |
| 6,966,154 | B1 | 11/2005 | Bierwirth | |
| 7,011,475 | B2 | 3/2006 | Shiraishi | |
| 8,714,880 | B1 * | 5/2014 | Mitchell | 405/230 |
| 8,821,073 | B2 * | 9/2014 | Patton | 405/232 |
| 2001/0046417 | A1 | 11/2001 | Iemura et al. | |
| 2004/0068125 | A1 | 4/2004 | Senal | |
| 2005/0238442 | A1 * | 10/2005 | Queen | 405/230 |
| 2006/0269364 | A1 * | 11/2006 | May | 405/232 |
| 2007/0028557 | A1 * | 2/2007 | Kelly et al. | 52/741.15 |
| 2007/0151173 | A1 | 7/2007 | Paugh | |
| 2007/0163186 | A1 * | 7/2007 | Baugh et al. | 52/169.9 |
| 2013/0042546 | A1 | 2/2013 | Bowlus et al. | |
| 2013/0152491 | A1 | 6/2013 | Jin et al. | |

FOREIGN PATENT DOCUMENTS

| | | |
|---|---|---|
| EP | 0816571 | 1/1998 |
| EP | 1947248 | 7/2008 |
| GB | 2291076 | 1/1996 |
| JP | 2009273162 | 10/1997 |
| JP | 2006104883 | 4/2006 |
| JP | 2007120232 | 5/2007 |
| JP | 2007158044 | 6/2007 |
| JP | 2011252806 | 12/2011 |
| JP | 2013084738 | 5/2013 |
| JP | 2013108253 | 6/2013 |
| JP | 2014001619 | 1/2014 |
| NZ | 272981 | 6/1998 |
| NZ | 286096 | 1/1999 |
| WO | 9517560 | 6/1995 |
| WO | 0173212 | 10/2001 |
| WO | 2008071249 | 6/2008 |
| WO | 2010110643 | 9/2010 |

OTHER PUBLICATIONS

Warn, G.P. and Ryan, K.L., "A Review of Seismic Isolation for Buildings: Historical Development and Research Needs", Buildings 2012, pp. 300-325 (Aug. 2012).

Undated Review (excerpt) of Skinner, R.I., Robinson, W.H., McVerry, G.H. *An Introduction to Seismic Isolation*; John Wiley and Sons Inc.: New York, NY, USA, 1993, 2 pages.

Patil, S.J. and Reddy, G.R State of Art Review—Base . Isolation Systems for Structures, International Journal of Emerging Technology and Advanced Engineering (vol. 2, Issue 7, Jul. 2012), *Earthquake Strengthen Your House*, Government of New Zealand (2014).

New Zealand Standard, "Timber-Framed Buildings", Standards, New Zealand, Paerewa Aotearoa, NZS3604:2011 (Feb. 2011).

* cited by examiner

SEISMIC ISOLATION SYSTEM

This application claims the benefit of New Zealand Patent Number 624344 filed on 30 Apr. 2014, the specification of which is hereby incorporated herein by reference.

BACKGROUND OF THE INVENTION

1. Field of the Invention

Embodiments of the invention generally relate to seismic base isolation systems for buildings and other structures. More specifically, a foundation system that is particularly advantageous to protect lightweight low rise buildings including houses against earthquakes, including those located in low lying wet regions subject to liquefaction.

2. Description of the Related Art

Generally, earthquakes occur all around the world with varying degrees of intensity, sometimes causing severe damage to property and life. Earthquakes in Japan, USA, South America, China and Europe have resulted in massive destruction of human lives and damages to buildings including houses.

Typically, earthquakes cause damage as a result of shaking and vibrations of the earth due to seismic waves generated by a collision of tectonic plates. The geology of the area through which the wave energy passes generally determines the extent of ground shaking Typically, a rocky ground mass may vibrate quickly with small displacements but may resist breakage. Generally, a low lying wet soil may, on the other hand, behave quite differently by shaking enough to allow water particles in soil to build substantial pressure such that soil particles lose cohesion and begin to behave like liquid themselves. This is called liquefaction and is generally responsible for much earthquake damage in certain low-lying wet areas through subsidence, lateral spread of the land, and silt forced to the surface. Typically, layers of sand liquefying below the ground surface under extreme pressure due to overlying sediments may exploit any fissure in the earth's mass under the foundation and burst out on the ground as an eruption of sand. This phenomenon generally known as 'sand volcano' may be as devastating for low rise buildings when the sand volcano forces wet sand up through cracks in the foundation or flooring.

Generally, seismic isolation, also known as base isolation, has emerged now days as an important concept and technique of designing buildings that are safe from seismic hazards. Using these concepts, base isolation devices are typically installed between the superstructure above the ground and the foundation which absorb earthquake energy and thereby impede the vibration and displacement of the building. As per a recent review disclosed in Patil, S. J. and G. R. Reddy (2012); *State of Art Review—Base Isolation Systems for Structures, International Journal of Emerging Technology and Advanced Engineering* (Vol 2, Issue 7, July 2012), base isolation concept was generally coined by engineers and scientists as early as in the year 1923. Since then methods of isolating the buildings and structures from earthquake forces have been developed all over the world. Countries such as the United States, New Zealand, Japan, China and Italy have generally adopted these techniques among the best practices for many public and multi-story residential buildings. Typically, hundreds of buildings are being built every year with base isolation technique in these countries. However due to factors such as weight and cost, typically, base isolation of light weight structures such as one and two story houses is very rare.

Generally, devices used for seismic isolation in buildings are isolators and dampers both of which are now of several different types and are being researched further using different materials and geometries. Typically, there are three main types of isolators:

Elastomeric Isolators that including packaged rubber and metal sheets alternately;

Sliding Isolators, typically made of Teflon™ coated steel sheet; and

Rotating Ball Bearing Isolator that include ball bearing with retainers.

Typically, all of these types of isolators allow moving the building laterally without minimal friction during an earthquake shaking Generally, among the first type of isolators, Lead-Rubber Bearings (LRBs), as disclosed in Skinner, R. I., Robinson, W. H., McVerry, G. H. *An Introduction to Seismic Isolation*; John Wiley and Sons Inc.: New York, N.Y., USA, 1993, were first introduced and used in New Zealand in the late 1970s. Since then, generally, LRBs have been widely used for seismic isolation around the world including the United States and Japan. Because of cost and technical complexity, typically, seismic isolators are very rarely used in low rise buildings and have been largely limited to large heavy important buildings such as hospitals, office buildings, and museums.

For example, patent and non-patent literature describe a number of base isolation devices with many improvements and associated techniques to handle varying conditions during an earthquake by minimizing the movement of the structure in relation to ground movement.

Despite worldwide popularity and use of known seismic isolation techniques, typically, there are situations when base isolation devices are of little use and fail to provide desired prevention of earthquake damage to buildings. A research study, as disclosed in Thurston, S J (2006); *Base Isolation of Low Rise Light and Medium-weight Buildings, BRANZ Study Report No* 156 (www.branz.co.nz), examined the question of base isolation of low rise light and medium-weight buildings in New Zealand using commercially available base isolation devices, such as Robal[1]™ and Roglider™, which are an LBR and a sliding isolator respectively. Generally, the study concluded that the potential use of base isolation systems for New Zealand houses and other low rise buildings is limited since lateral load resistance of the isolation devices is likely to be generally quite low which would prompt significant reduction of design level seismic force in the superstructure, as a result of which most buildings will move excessively under design level or extreme wind forces. Typically, seismic isolation succeeding in such cases would be possible by counter measure of increasing the weight of the structure beyond what is normally required. Thus, generally, conventional seismic isolation may be expensive to implement and maintain in such cases that could be justified if prevention of damage to contents is, prima facie, the objective.

Furthermore, generally, due to the failure of known seismic isolation techniques in situations described above, the occurrence of liquefaction in certain low lying wet soils compound the problem of seismic safety of buildings even further. Typically, liquefaction-induced damages have been observed in many moderate to severe earthquakes, most recently in 2011 in Japan and New Zealand, and earlier in California, Greece, Italy and Turkey.

Generally, according to a key seismic isolation principle, the seismic isolator used should enable the structure above the foundation to have a swing period longer than the vibration period of seismic origin. The phenomenon of liquefaction, on the other hand, typically affects the soil under the foundation and supporting piles. Liquefaction could be prevented, generally, if the pore pressure of soil moisture can be prevented to build up appreciably during seismic vibration such that soil under the foundation continues to remain unsaturated and maintains its frictional resistance as before.

Generally, prior art patent literature describe several techniques to solve the problem of liquefaction in different situations. For example, Japanese Patent 7158044 describes the use of gravel drainage column encased in a synthetic bag pushed through in the ground near the foundation inside a casing pipe which is press-rotated with a mechanical drive and extracted out afterwards. The method is suggested for prevention of liquefaction in the event of an earthquake.

Japanese Patent Publication 2013108253, to Tezuka et al., entitled "A Liquefaction measure Device" describes a more sophisticated liquefaction countermeasure than the above by providing an expendable bladder inside the piers to take in water during a liquefaction phase and keeping the soil around the piers unsaturated. The system of Tezuka et al. also provides earthquake detection means and initiating the expansion of bladder automatically upon detection of earthquake. Other approaches include U.S. Pat. No. 6,308,135, to Hocking, entitled "Soil Liquefaction Prevention by Electro-Osmosis During an Earthquake Event", describes the use of electro-osmosis to move the water away from foundation, and U.S. Pat. No. 6,659,691, to Berry, entitled "Pile Array Assembly System for Reduced Soil Liquefaction", discloses a pile array assembly that deflects seismic shock waves thereby densifying the ground to reduce liquefaction.

Generally, the use of piles as support for foundation is not new. For example, prior art techniques describe many instances where piles driven into the ground have been used to support a foundation above the ground. For example, New Zealand Patent 272981, to Melville-Smith, entitled "Improvements in or Relating to Foundations" describes a methodology of constructing a concrete foundation on the surface of the ground resting on piles, which are preferably wooden and driven into the ground; wherein such a foundation also acting as floor upon which building structure can be erected. The improvement appears to use piles to replace the cement footing in excavated ground. The invention, however, appears to lack any mention of seismic activity or resilience and the cement slab foundations on the ground surface would be prone to movement and cracking during an earthquake.

Generally, houses built on timber or concrete piles are quite common in New Zealand and elsewhere in the world. For example, the current New Zealand Standard for Timber Framed Buildings, NZS3604:2011, applicable to all new construction prescribes, among other things, specific requirements for ground type and bearing capacity, pile layout, pile height above ground, pile type & size etc. In the aftermath of recent Christchurch earthquake and widespread damage of building properties, the awareness campaign launched by the Government of New Zealand through a web-based guidance note entitled, '*Earthquake Strengthen Your House*', generally advises on periodic check of timber and concrete piles that may have been damaged and/or dislocated away from the bearers. It is also recommended to ensure that piles are directly and properly secured to the bearers through z-nails or braces.

Liquefaction associated failure may be of the following types:

Tilting due to instability,

Direct settlement due to loss of bearing capacity,

Uplift due to buoyancy effects and

Structural deformation due to lateral spread of the ground.

Generally, these phenomena are now better understood as a result of detailed studies on the causes and impact of liquefaction on major infrastructure projects like bridges etc. after major earthquakes in recent years in different parts of the world. A number of mitigation and countermeasures to the effect of liquefaction such as compaction techniques now recommended commonly for large projects are, however, generally not practicable and cost-effective for small residential housing projects.

Typically, buildings with foundation of concrete platform resting on piles or excavated footings have shown that current methods are not effective in certain areas where the building rests on piles or footings in a liquefiable soil and are not capable to withstand the effect of a moderate to strong earthquake without extensive and expensive ground preparation. Generally, when the bottom of the foundation platform is cracked, liquefaction causes water and mud to erupt upwards with force through cracks and above the foundation, making the building no longer habitable. If liquefaction has caused the slab to subside, then typically very expensive re-leveling will be required and repairs to the structure due to foundation subsidence can exceed the cost of building a new equivalent house.

Generally, foundations using piles and attached floor joists or bearers are subject to racking and deforming during an earthquake causing shifts in floor levels and related damage to the structure of the buildings. The racking and deforming, typically, may be increased in liquefiable soils due to greater horizontal and vertical movement of the piles.

Therefore, in view of the above, there is a need for an alternate solution for foundation for light weight structures and buildings in low lying wet regions such as those of north-eastern region of India in Assam or lands of technical category 3 of Canterbury region in New Zealand that have been officially assessed to experience moderate to significant land damage from liquefaction in future large earthquakes, or at least provide the public with a choice.

Further aspects and advantages of the system will become apparent from the ensuing description that is given by way of example only.

BRIEF SUMMARY OF THE INVENTION

One or more embodiments of the invention include a seismic base isolation system for buildings and other structures that is well suited to protect lightweight low rise buildings including houses against the earthquakes particularly where the structure is located in low lying wet regions subject to liquefaction.

In one or more embodiments, there is provided a seismic isolation building system including one or more of:

- at least one structural platform laid horizontally on a ground surface providing a foundation for a structure thereon;
- a plurality of piles extending from the platform into the ground on which the platform is placed;
- at least one plate inserted between the pile and platform that is fixed to the platform (platform plate); and,
- at least one further plate (pile plate) fixedly linked to the pile and which abuts the platform plate;
- wherein the one or more piles are connected to the at least one platform via at least one shear bolt that links a platform plate to a pile, wherein the at least one bolt is designed to shear in the event of a predetermined level of seismic activity freeing the platform or platforms to move independent of the piles and which may then, post seismic activity, be moved, repositioned and/or re-fixed to new or existing piles.

At least one embodiment of the invention includes a method of seismically isolating a building structure by the step of isolating the structure from the ground by use of the system substantially as described above.

One or more embodiments of the invention advance the art of seismic base isolation devices for light weight structures in liquefaction prone areas by use of a novel design that may dissipate the kinetic energies of ground displacement as well as address the issue of liquefaction. At least one embodiment of the invention includes a simple design that is easy to understand and practice, and which is particularly suitable for light weight structures in seismic prone low lying wet regions with potential to suffer liquefaction.

BRIEF DESCRIPTION OF THE DRAWINGS

The above and other aspects, features and advantages of at least one embodiment of the invention will be more apparent from the following more particular description thereof, presented in conjunction with the following drawings, wherein.

DETAILED DESCRIPTION OF THE INVENTION

Figure 1:
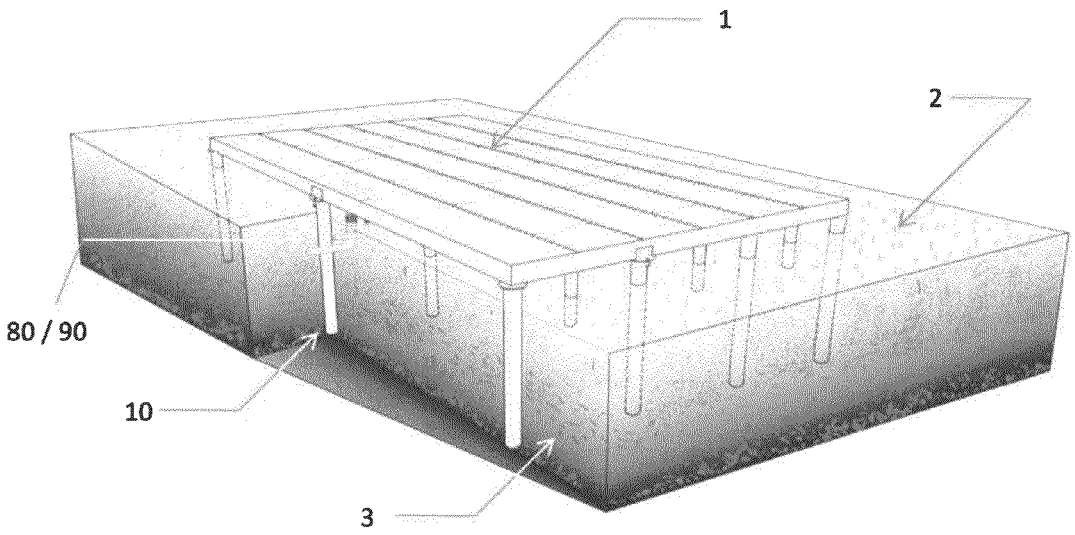
FIG. 1 illustrates a schematic representation of an embodiment of the system as a whole being a rectangular shaped platform constructed from structural insulated panels (SIP's) resting on piles.

The following description is of the best mode presently contemplated for carrying out at least one embodiment of the invention. This description is not to be taken in a limiting sense, but is made merely for the purpose of describing the general principles of the invention. The scope of the invention should be determined with reference to the claims.

One or more embodiments of the invention include a seismic base isolation system for buildings and other structures that is configured to protect lightweight low rise buildings, including houses, against earthquakes, particularly where the structure is located in low lying wet regions subject to liquefaction.

For the purposes of this specification, in embodiments of the invention, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

For the purposes of this specification, in embodiments of the invention, the term 'substantially' or grammatical variations thereof refers to at least about 50%, for example 75%, 85%, 95% or 98%.

For the purposes of this specification, in embodiments of the invention, the term 'comprise' and grammatical variations thereof shall have an inclusive meaning—i.e. that it will be taken to mean an inclusion of not only the listed components it directly references, but also other non-specified components or elements.

In one or more embodiments, the term 'SIPs' or structural insulated panel or panels or grammatical variations thereof refer to composite building material consisting of an insulating layer of rigid core sandwiched between two layers of structural board.

In one or more embodiments, the term 'piles' or grammatical variations thereof refer to relatively long slender columns, most commonly manufactured from timber, driven into the ground with a portion remaining above ground and a vertical load such as a building structure is placed on the pile endings above the ground.

In one or more embodiments, the term 'shear bolt' or grammatical variations thereof as used herein refers to a bolt or similar part/assembly such as pins or other fasteners, that is designed to break when a specific shear force is reached between two bodies that the shear bolt is linked to, the shear force being in substantially opposing directions.

At least one embodiments of the invention includes a seismic isolation building system including one or more of:

- at least one structural platform laid horizontally on a ground surface providing a foundation for a structure thereon;
- a plurality of piles extending from the platform into the ground on which the platform is placed;
- at least one plate inserted between the pile and platform that is fixed to the platform (platform plate); and,
- at least one further plate (pile plate) fixedly linked to the pile and which abuts the platform plate;
- wherein the one or more piles are connected to the at least one platform via at least one shear bolt that links a platform plate to a pile, wherein the at least one bolt is designed to shear in the event of a predetermined level of seismic activity freeing the platform or platforms to move independent of the piles and which may then, post seismic activity, be moved, repositioned and/or re-fixed to new or existing piles.

In one or more embodiments, the at least one platform may be at least one structural insulated panel (SIP) or panels (SIPs).

In at least one embodiments, the at least one SIP panel may include an enclosure made of two structural panels or boards and an insulation material within the enclosure. In one or more embodiments, the structural board or boards may be orientated strand board (OSB) but as may be appreciated, the structural board may also be sheet metal, plywood, cement, magnesium oxide board and combinations of these materials. Examples of core materials may be expanded polystyrene foam (EPS), extruded polystyrene foam (XPS), polyisocyanurate foam, polyurethane foam or composite honeycomb (HSC) and combinations thereof. In one or more embodiments, the core materials may be in the form of pellets, beads, foams and so on without departing from the scope of the invention herein. In at least one embodiment, SIPs panels may share the same structural properties as an I-beam or I-column.

In one or more embodiments, the SIP panel may also include one or more internal beams. In at least one embodiment, the SIP's panels may be fastened to rim perimeter boards on the sides and at least one truss beam may also be located inside the panel(s). In one or more embodiments, additional beams and structures like this may be helpful to add strength and/or rigidity to the SIP as may be required for example to carry a heavier structure thereon.

By way of at least one embodiment, the platform plate and pile plate may be substantially flat plates which slide against each other with a calculable amount of friction.

In one or more embodiment, the pile plate may be a smaller size than the platform plate.

In at least one embodiment, the plate or plates may be circular in shape. The plates may on assembly share a common center point.

According to one or more embodiments, the shear bolt or bolts may link the pile to the platform plate and not attach to the pile plate.

In at least one embodiment, the shear bolt or bolts may be linked to the pile via a collar that fits around the pile and which includes at least one flange to which one end of a bolt attaches to.

By way of one or more embodiments, the plates may be manufactured from materials with a specific coefficient of friction at the opposing surfaces to resist sliding between the plate surfaces. In at least one embodiment, the plate or plates may be manufactured from steel. In one or more embodiments, steel may be a useful material as it is strong and resilient, and the surface may be prepared to suit the desired level of friction. In at least one embodiment, other materials may also be used, such as carbon fiber or polymer composites.

In one or more embodiments, service lines may pass through the foundation. In at least one embodiment, the services lines may be manufactured from a flexible and/or extendable material. This may be an advantage in the event of liquefaction allowing the service lines to extend and move in relation to the structure movement relative to the ground, yet remain connected thereby having some resilience to movement.

In one or more embodiments, the piles may be formed as helical screws. This may be an advantage to speed the process of inserting the piles into the ground, wherein various shapes of pile, and techniques to insert the piles may be used herein as well.

In at least one embodiment, the piles may be posts manufactured from treated wood. In one or more embodiments, the piles may be manufactured from concrete either offsite or poured on site for example into formwork or mold. In at least one embodiment, the piles may be manufactured from steel. In one or more embodiments, the piles may be manufactured from composite materials. As should be appreciated, the materials used to form the piles may be quite varied and adjusted to suit the location and structural strength desired.

By way of at least one embodiment, the piles may have integrated therein, one or more fine height adjustment elements. In one or more embodiments, the fine height adjustment elements may for example be twist screws located between the pile head and pile plate. In one or more embodiments, the fine height adjustment elements allow the ability to re-level a structure post a ground movement without having the re-adjust the pile position. In at least one embodiment, adjustment of the fine height adjustment element alters the platform position.

One or more embodiments of the invention may include a substantially impermeable barrier between the at least one platform and the ground on which the platform is placed. This barrier, in at least one embodiment, may assist in preventing liquefaction materials entering through the foundation base. The barrier, in one or more embodiments, may also wrap around at least a portion of the lower edges of the at least one platform and/or structure above so as to also provide a barrier around the lower sides of the structure. Non-limiting examples of such impermeable materials, in at least one embodiment, may include various semi-rigid to rigid materials such as plastic sheets made from polyvinyl chloride (PVC), high density polyethylene (HDPE), polyurethane (PU) and acrylonitrile butadiene styrene (ABS). In one or more embodiments, the impermeable barrier may also be itself insulating or a further insulating material may be located between the impermeable barrier and at least one platform.

At least one embodiment of the invention includes a method of seismically isolating a building structure by the step of isolating the structure from the ground by use of the system substantially as described above.

As may be appreciated from the above description, in one or more embodiments, the system described addresses the twin problems of damage occurring to light weight structures, houses and other buildings located on low lying potentially liquefiable lands due to earthquake and due to liquefaction. In one or more embodiments, this is achieved by meeting two criteria namely:

- The foundation platform on which the housing structure would be raised may be in contact with the piles in a manner that allows the base isolation principle to be operational when needed; and
- The foundation platform on which the housing structure would be raised may be sufficiently strong structurally to prevent deformation when piles shift due to earthquake or liquefaction and impervious from the bottom to prevent upward thrust of the liquefied materials entering into the houses.

Keeping these two objectives in mind, by way of at least one embodiment, the foundation system described herein may be conceived and developed. One or more embodiments of the invention provide adequate protection for light weight structures in vulnerable areas where no known base isolation or other countermeasures against liquefaction may be economically or technically feasible.

Because of the use of steel plates, by way of at least one embodiment, the lateral resistance to movement may be easily determined by the weight of the structure and the amount of friction between the surface of the two plates (the SIP plate and pile plate). Extreme winds or small tremors may move the structure in the absence of any connection between the piles and the foundation platform and therefore, in one or more embodiments, a shear bolt may be provided on at least one side of the foundation to securely connect it with given pile (s). In at least one embodiment, as seismic load exceeds beyond the calculated lateral pressure due to maximum anticipated wind velocity and crosses the designed shear point of the shear bolt, the seismic load will break the shear bolt(s) thus freeing the structure to allow piles with their top plates to slide and/or lift relative to the foundation plates isolating the foundation platform and the structure built on it. Strong vertical seismic movements may also shear the bolts. In one or more embodiments, the structure would be protected from up and down movements by the steel plates. In at least one embodiment, the structure may be protected from liquefaction by being off the ground and having an impenetrable bottom layer or layers on the foundation platform. In at least one embodiment, damage from movement of the piles caused by liquefaction such as subsidence, lateral land movement or pile floatation would be mitigated because the platform foundation would be isolated from the piles. As such, in at least one embodiment, services would be protected by having all connections joined by flexible rubber connections. Post-earthquake, in one or more embodiments, the foundation platform and the house could be easily re-leveled and the damaged or displaced piles may be replaced. In at least one embodiment, the foundation platform and house may be lifted up and removed to another site. In one or more embodiments, services going through the ground may be routed over land to street connections or collection and supply tanks temporarily thus quickly restoring services such as sewage and water.

One or more embodiments may include elements and features referred to or indicated in the specification of the application, individually or collectively, and any or all combinations of any two or more said parts, elements or features, and where specific integers are mentioned herein which have known equivalents in the art to which the embodiments relates, such known equivalents are deemed to be incorporated herein as of individually set forth.

Where specific integers are mentioned in one or more embodiments herein, which have known equivalents in the art to which this invention relates, such known equivalents are deemed to be incorporated herein as if individually set forth.

WORKING EXAMPLE

One or more embodiments may be described by reference to a specific example, as discussed below.

Example 1

By way of at least one embodiment, a working example may include an assembled foundation platform (1) resting on piles as shown in a perspective view in FIG. 1. In one or more embodiments, this is a rectangular shaped foundation platform on which the building structure may be raised. In one or more embodiments, the platform of a desired size may be pre-fabricated off site or assembled or constructed on site as explained below. In at least one embodiment, the platform may be of any reasonable size or shape depending on the intended design of the house and available plot size.

Figure 2:
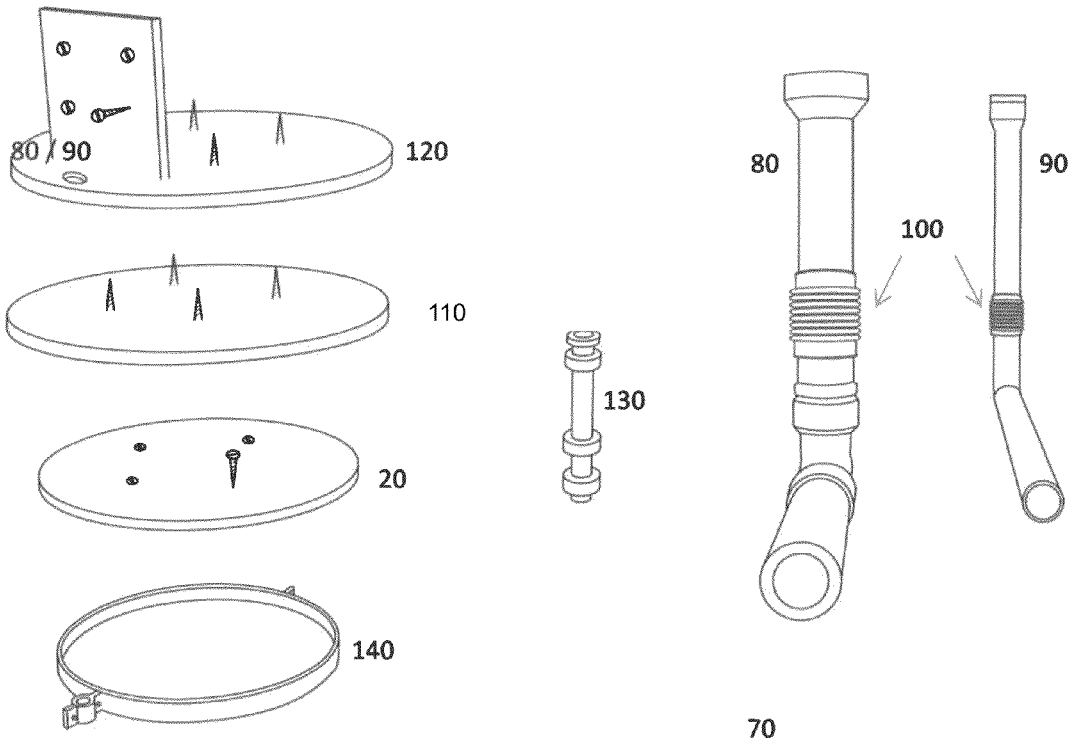
FIG. 2 illustrates schematic detail views of various components of the foundation system.

With some key components as shown in FIG. 2, by way of one or more embodiments, the construction of foundation platform may proceed in several steps, not necessarily in the same sequential order as described below.

Constructing the Foundation System:

Step 1—Ground Preparation

In at least one embodiment, the ground may be in a smooth horizontal plane and appropriate provision for laying sewer and other utility connections may be made.

Step 2—Fixing piles

Figure 3:
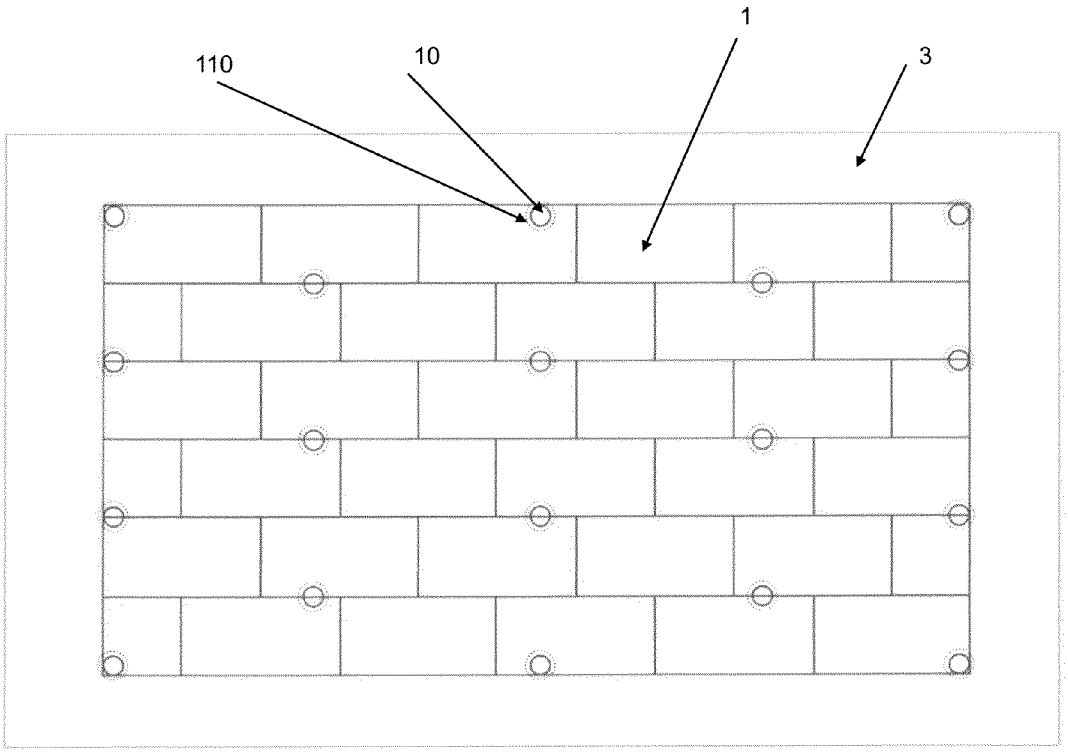
FIG. 3 illustrates a plan view from above of the foundation system illustrating a typical layout of piles beneath the constructed platform.

In one or more embodiments, the pile (10) used in this example may be pressure treated timber of about 300 mm diameter and 1.5 meters long. In at least one embodiment, in practice, not only type, size and the width of the piles may vary considerably, their numbers, location below foundation platform may also vary and may be optimized with substantial cost savings with appropriate design calculations. In at least one embodiment, the size (width and length) of the piles may be as described above and their numbers and location with respect to the area covered by the foundation platform may be as shown in FIG. 3. In one or more embodiments, the piles (10) may be made instead of concrete onsite or offsite, or of steel or composite material pole like structures cylindrical in shape with or without helical screw-like threads on the outer surface or be in the shape of square pile; the top-end of the pile (10) projecting above the ground, however, may be flat and smooth on to which pile plate (20) can be fixed horizontally.

In at least one embodiment, with piles (10) driven or set in the ground up to a given depth with their top ends projecting upwards above the ground at a common height at pre-determined locations, the next step is to install pile plates (20) on each pile head. In this example, according to one or more embodiments, the pile plates (20) may include simple circular plates of 350 mm diameter and 10 mm thickness. In at least one embodiment, the pile plate (20) may be of any other suitable diameter and thickness, however it is important that pile plate (20) may fully cover the pile head and may be larger than the area of pile head. In at least one embodiment, pile plate (20) like platform plates (110/120), in this example, may include good quality structural steel but in practice may also be of carbon fiber, polymer or composite materials.

In one or more embodiments, pile plate (20) may include conical holes which permit fixing the same with screws which are countersunk into the plates such that when fixed on to the pile, they are flush and smooth on the top end. In at least one embodiment, similar platform plates from the foundation with their outer surface similarly flush and smooth when in contact with pile plates may be made to slide against each other. In one or more embodiments, the top smooth and solid surface at the pile head may be provided in many different ways. For example, in at least one embodiment, a specially designed plate having a cup shape projection in the bottom with which the pile head is capped. In one or more embodiments, maintaining a smooth and solid top surface at the pile head with its counterpart plate from the bottom of the foundation may be an advantage for reasons as will become apparent below.

Step 3—Construction of the Foundation Platform

In one or more embodiments, the foundation platform may be built with what is referred herein as structural insulated panels (SIPS), which may be made of a top and bottom sheets of plywood or orientated strand board (OSB) with a rigid core of dense insulating material between the two layers. In at least one embodiment, the SIPS may be durable and structurally strong. While top SIP Sheet (30) can be an Oriented Strand Board (OSB) of 1200×2400×20 (mm) or similar, in one or more embodiments, the bottom SIP sheet (40) may be a treated plywood of 1200×2400×25 (mm) or similar. In at least one embodiment, the bottom sheet of the SIP (40) may be of considerable strength and adequate thickness to support the steel plates attached under with screws and therefore may be of 25 mm thickness or more. In one or more embodiments, in the horizontal plane, both the SIP (Top Sheet) (30) as well as the SIP (Bottom Sheet) (40) may be of similar size and the SIPS may be connected together with a Vertical Truss Beam (50) between the SIP (Top Sheet) (30) and the SIP (Bottom Sheet) (40). In at least one embodiment, the SIPS may be 1200×2400 (mm) but, in practice, these may be of any other size in keeping within the scope of the invention. In one or more embodiments, the individual SIPS may be factory made panels of standard size usually 1200×2400 (mm) and glued and screwed together using trusses and the rim perimeter beams (50 and 60) to build the foundation platform (1). FIG. 1 shows a foundation system with 33 SIPS assembled together into a foundation platform (1) measuring an area of 95.04 square meters (~1023 square feet), according to one or more embodiments. In at least one embodiment, both the size of SIPs as well as the total plot area may vary considerably in actual practice and may be customized to actual need.

Figure 4:
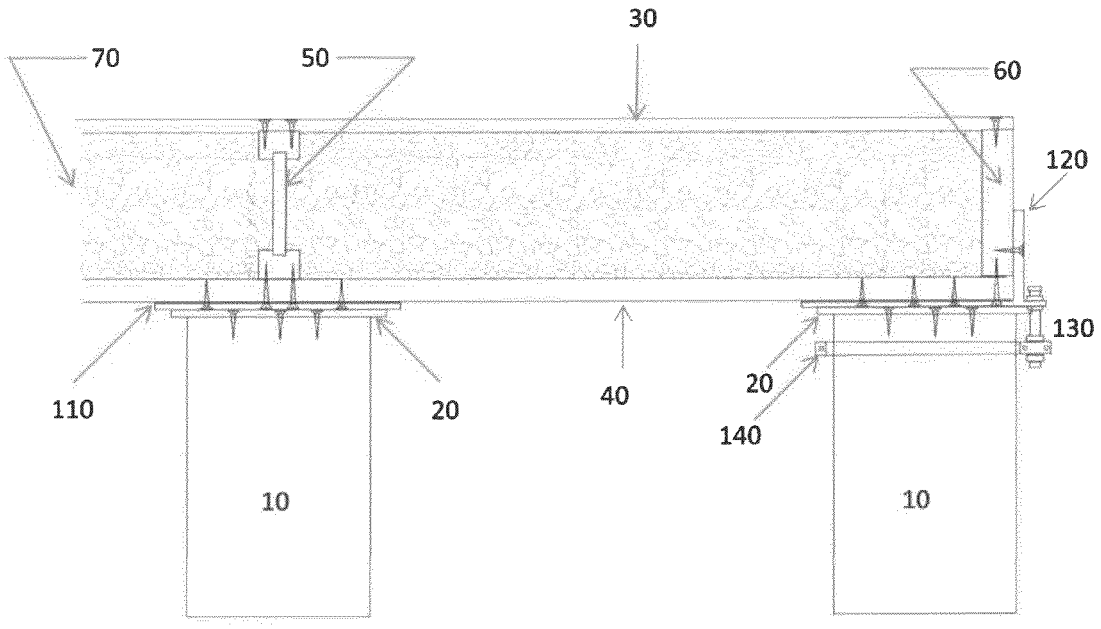
FIG. 4 illustrates a side cross section view of a portion of the foundation system constructed with structural insulated panels (SIPS) and showing i) dense insulating material between the top and bottom sheets of the panels, ii) platform plate of the foundation resting on top plate of the pile and iii) shear-bolt mechanism connecting the platform/rim plate of the foundation with the pile on a perimeter.

In one or more embodiments, both the truss beam (50) and rim perimeter beam (60) may be timber or engineered wood products such as linear veneer lumber or constructed of a combination of linear veneer lumber and other materials including Oriented Strand Board, and may be of equal height to foundation platform when fixed vertically running parallel to each other. In at least one embodiment, the truss beam (50) and rim perimeter beam (60) may be 240 mm wide to provide that much vertical height of the foundation platform. In at least one embodiment, both these Truss and Rim perimeter beams (50 and 60) may be connected vertically with the SIP (top sheet) (30) and the SIP (bottom sheet) (40) as shown in FIG. 4. In one or more embodiments, the space between SIP (top sheet) (30) and SIPs (bottom Sheet) (40) may be rigid dense insulating material (70). In one or more embodiments, there are a wide range of plastic and polymer based insulating materials that may be successfully used, such as rigid PVC, high density polyethylene, acrylonitrile butadiene styrene (ABS), polyurethane (PU) and expanded polystyrene depending upon the cost and performance in different situations. In one or more embodiments, the choice of insulating material may include expanded polystyrene which tends to be not only a low cost option but also offers qualities of being light weight, very buoyant, moisture resistant with excellent insulating properties thus requiring no additional floor insulation for heated or cooled homes.

In at least one embodiment, during construction of the platform, provision for sewage pipe (80) and water and other services (90) as per the design of the house may also be created allowing them to pass through the foundation (not shown) that may be connected through one or more flexible rubber connections (100).

In one or more embodiments, the foundation platform thus constructed may support the designed load of the structure above it. In comparison to concrete slab, in at least one embodiment, the foundation platform, constructed as described above is resilient and relatively light and strong. In the event of earthquake and liquefaction, in at least one embodiment, it may have the tendency to stay afloat and would not sink and/or crack thus providing much better protection than conventional slab foundations.

Step 4—Fixing foundation platform plates

By way of at least one embodiment, platform plates (110 and 120) are essentially similar to pile plates (20) but relatively larger in diameter; when in contact with each other, they may slide on each other. In one or more embodiments, the platform plates may include two types, referred here as foundation platform plate (110) and foundation platform/Rim plate (120), wherein the latter may include an additional vertical upward projection to support the side of the foundation platform (1) when fixed on the perimeter. In one or more embodiments, both platform plates may be 400 mm in diameter but foundation platform/rim plate (70) has an additional vertical plate of 150 mm height at right angle to the base of 400 mm diameter facing upwards which, in practice, may be of a different diameter but should be larger than the pile plate (20).

In at least one embodiment, both platform plates (110 and 120), may be plain and smooth from the bottom with conical holes for fixing screws that may be countersunk into the plates, such that when fixed into the bottom of the foundation platform they may be flat and smooth. In one or more embodiments, the layout of platform plates on the platform may match with that of the layout of piles (10) and top plates (20) on their heads as in FIG. 3. In at least one embodiment, all required platform plates may be affixed to the bottom of foundation platform as per the planned layout, in such a manner that when foundation platform is placed on the piles, each platform plate (110 and 120) exactly sits on a corresponding pile plate (20). Of all the platform plates, by way of at least one embodiment, there may be two foundation platform/rim plates (120) on any two sides of the foundation platform (1). Foundation platform/rim plates (120), in one or more embodiments, may be designed for the dual function of supporting the edges of the platform foundation (1) as well as connecting with piles (10) through Shear Bolts (130) as explained below.

Step 5—Fixing the shear bolts

According to one or more embodiments, the last step in the process is fixing shear bolts (130) through the foundation platform/rim plates (120) with piles (10) with the help of pile to shear bolt connectors (140) as shown in FIG. 4. In at least one embodiment, shear bolts (130) may be a key feature of this system which may be designed as a bolt made of a relatively soft material that is designed to shear and break from excessive damaging shocks or seismic loads during moderate to severe earthquakes. When shear bolts (130) break, in at least one embodiment, the foundation platform (1) and the piles (10) with steel plates (20 and 110/120) in between may be in base isolation mode and may slide over each other and thus preserve the foundation platform (1) and the rest of the structure over it from excessive damage.

The description of shear bolt (130) in this example is again purely illustrative. In one or more embodiments, there may be other mechanisms and modes to deploy shearing examples of which include shear pins or non-threaded fasteners.

By way of at least one embodiment, with completion of all the steps described above, the foundation platform (1) is ready for building the required housing structure over it. Besides being lightweight, in one or more embodiments, the foundation platform (1) and all other components described are cost-effective. All material used herein, in at least one embodiment, may be easily repaired and replaced when necessary.

To successfully design this system, according to one or more embodiments, two key calculations may be used by the practicing engineer.

In at least one embodiment, the first calculation may take into account the type of ground and the proposed structure with its total load including that of the foundation platform (1) and calculate the size, number, location and the depth of the piles (10) required and the size and depth of the foundation platform (1) and its construction (trusses, type and size of panels, etc.). In at least one embodiment, this calculation may be done by a practicing engineer.

By way of at least one embodiment, the second calculation may determine the required shear strength to break the connection between the foundation platform (1) and the piles (10) taking into account the anticipated seismic, wind and structural loads together with frictional resistance of foundation platform plates (110/120) and pile plates (20). Based on the result an appropriate, in at least one embodiment, Shear Bolt may be determined. In one or more embodiments, the calculations may be made by a practicing engineer and with shear bolts with a wide range of specified breaking strength.

It will be apparent to those skilled in the art that numerous modifications and variations of the described examples and embodiments are possible in light of the above teaching. The disclosed examples and embodiments are presented for purposes of illustration only. Other alternate embodiments may include some or all of the features disclosed herein. Therefore, it is the intent to cover all such modifications and alternate embodiments as may come within the true scope of this invention.

What is claimed is:

1. A seismic isolation building system comprising:

at least one structural platform laid horizontally on a ground surface providing a foundation for a structure thereon;

a plurality of piles extending from the platform into the ground surface on which the at least one structural platform is placed;

at least one plate inserted between the pile and platform that is fixed to the platform, wherein said at least one plate comprises at least one platform plate; and, at least one further plate fixedly linked to the pile and which abuts the platform plate, wherein said at least one further plate comprises at least one pile plate;

wherein the plurality of piles are connected to the at least one structural platform via at least one shear bolt that links a platform plate of said at least one platform plate to a pile of said plurality of piles, and, wherein the at least one shear bolt is designed to shear during a predetermined level of seismic activity freeing the at least one structural platform to move independent of the plurality of piles, and which, post seismic activity, be moved, repositioned and/or re-fixed to new piles or existing piles of said plurality of piles.

2. The system as claimed in claim 1, wherein the at least one platform is at least one structural insulated panel (SIP).

3. The system as claimed in claim 2, wherein the at least one SIP comprises a core manufactured from expanded polystyrene foam (EPS), extruded polystyrene foam (XPS), polyisocyanurate foam, polyurethane foam or composite honeycomb (HSC).

4. The system as claimed in claim 2, wherein the SIP comprises two opposing structural panels or boards manufactured from orientated strand board (OSB), sheet metal, plywood, cement, magnesium oxide or any combinations thereof.

5. The system as claimed in claim 1, wherein the at least one structural platform is fastened to sides of rim perimeter boards, and further comprising at least one truss beam located inside or about the at least one structural platform.

6. The system as claimed in claim 1, wherein the at least one platform plate and the at least one pile plate are flat plates which slide against each other with a calculable amount of friction.

7. The system as claimed in claim 1, wherein the at least one pile plate is smaller than the at least one platform plate.

8. The system as claimed in claim 1, wherein one or more of the at least one platform plate and the at least one pile plate is circular in shape.

9. The system as claimed in claim 1, wherein the at least one shear bolt links the pile to the at least one platform plate, and wherein the at least one shear bolt is not attached to the at least one pile plate.

10. The system as claimed in claim 1, wherein the at least one shear bolt is linked to the pile via a collar that fits around the pile and which includes at least one flange to which one end of a bolt of the at least one bolt attaches to.

11. The system as claimed in claim 1, wherein one or more of the at least one platform plate and the at least one pile plate is manufactured from materials with a specific coefficient of friction at opposing surfaces to resist sliding between plate surfaces of the at least one platform plate and the at least one pile plate.

12. The system as claimed in claim 1, wherein one or more of the at least one platform plate and the at least one pile plate is manufactured from steel.

13. The system as claimed in claim 1, wherein at least one service line passes through the at least one structural platform, wherein the at least one service line is manufactured from a flexible and/or extendable material.

14. The system as claimed in claim 1, wherein a substantially impermeable barrier is placed between the at least one structural platform and the ground surface on which the at least one structural platform is placed.

* * * * *